US007945449B2

(12) United States Patent
Vinton et al.

(10) Patent No.: US 7,945,449 B2
(45) Date of Patent: May 17, 2011

(54) TEMPORAL ENVELOPE SHAPING FOR SPATIAL AUDIO CODING USING FREQUENCY DOMAIN WIENER FILTERING

(75) Inventors: Mark Stuart Vinton, San Francisco, CA (US); Alan Jeffrey Seefeldt, San Francisco, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 823 days.

(21) Appl. No.: 11/888,651

(22) Filed: Jul. 31, 2007

(65) Prior Publication Data

US 2008/0033731 A1 Feb. 7, 2008

Related U.S. Application Data

(63) Continuation of application No. 11/660,893, filed as application No. PCT/US2005/029157 on Aug. 15, 2005.

(60) Provisional application No. 60/604,836, filed on Aug. 25, 2004.

(51) Int. Cl.
*G10L 21/00* (2006.01)

(52) U.S. Cl. ..... 704/500; 704/229

(58) Field of Classification Search ..... 704/229, 704/500–504

See application file for complete search history.

(56) References Cited

U.S. PATENT DOCUMENTS

| | | | | |
|---|---|---|---|---|
| 5,523,396 | A | 6/1996 | Sato | |
| 5,539,829 | A | 7/1996 | Lokhoff | |
| 5,583,962 | A | 12/1996 | Davis | |
| 5,606,618 | A | 2/1997 | Lokhoff | |
| 5,621,855 | A | 4/1997 | Veldhuis | |
| 5,632,005 | A | 5/1997 | Davis | |
| 5,633,981 | A | 5/1997 | Davis | |
| 5,636,324 | A * | 6/1997 | Teh et al. | 704/226 |
| 5,727,119 | A | 3/1998 | Davidson | |
| 5,812,971 | A | 9/1998 | Herre | |
| 6,021,386 | A | 2/2000 | Davis | |
| 6,502,069 | B1 | 12/2002 | Grill et al. | |
| 6,691,086 | B2 | 2/2004 | Lokhoff | |
| 7,116,787 | B2 | 10/2006 | Faller | |
| 7,394,903 | B2 * | 7/2008 | Herre et al. | 381/23 |
| 7,447,629 | B2 * | 11/2008 | Breebaart | 704/219 |
| 2003/0035553 | A1 | 2/2003 | Baumgarte | |
| 2003/0187663 | A1 | 10/2003 | Truman et al. | |
| 2003/0195742 | A1 | 10/2003 | Tsushima et al. | |

(Continued)

FOREIGN PATENT DOCUMENTS

WO WO 03/007656 A1 1/2003

(Continued)

OTHER PUBLICATIONS

International Search Report, PCT/US2005/029157, Feb. 13, 2006.

(Continued)

*Primary Examiner* — Abul Azad

(57) ABSTRACT

Certain types of parametric spatial coding encoders use interchannel amplitude differences, interchannel time differences, and interchannel coherence or correlation to build a parametric model of a multichannel soundfield that is used by a decoder to construct an approximation of the original soundfield. However, such a parametric model does not reconstruct the original temporal envelope of the soundfield's channels, which has been found to be extremely important for some audio signals. The present invention provides for the reshaping the temporal envelope of one or more of the decoded channels in a spatial coding system to better match one or more original temporal envelopes.

13 Claims, 2 Drawing Sheets

U.S. PATENT DOCUMENTS

| | | | | |
|---|---|---|---|---|
| 2003/0219130 | A1 | 11/2003 | Baumgarte et al. | |
| 2003/0236583 | A1 | 12/2003 | Baumgarte et al. | |
| 2004/0086130 | A1* | 5/2004 | Eid et al. | 381/20 |
| 2004/0125487 | A9 | 7/2004 | Sternad | |
| 2005/0058304 | A1* | 3/2005 | Baumgarte et al. | 381/98 |
| 2006/0009225 | A1* | 1/2006 | Herre et al. | 455/450 |
| 2007/0140499 | A1 | 6/2007 | Davis et al. | |
| 2008/0040103 | A1 | 2/2008 | Vinton et al. | |
| 2008/0046253 | A1 | 2/2008 | Vinton et al. | |

FOREIGN PATENT DOCUMENTS

| | | | |
|---|---|---|---|
| WO | WO 03/090206 | A1 | 10/2003 |
| WO | WO 03/090207 | A1 | 10/2003 |
| WO | WO 03/090208 | A1 | 10/2003 |
| WO | WO 2006/026161 | A2 | 3/2006 |

OTHER PUBLICATIONS

Written Opinion of the International Searching Authority, PCT/US2005/029157, Feb. 13, 2006.

Schuijers, Erik, et al., Audio Engineering Society, Convention Paper 5852, "Advances in Parametric Coding for High-Quality Audio", Presented at the 114$^{th}$ Convention, Amsterdam, The Netherlands, Mar. 22-25, 2003.

Herre, J., et al., Audio Engineering Society, Convention Paper 6447, "The Reference Model Architecture for MPEG Spatial Audio Coding", Presented at the 118$^{th}$ Convention, Barcelona, Spain, May 28-31, 2005.

ATSC Standard A52/A: Digitial Audio Compression Standard (AC-3), Revision A, Advanced Television systems Committee, Aug. 20, 2001. The A52/A document is available on the World Wide Web at http://www.atsc.org/standards.html.

Vernon, Steve, "Design and Implementation of AC-3 Coders," IEEE Trans. Consumer Electronics, vol. 41, No. 3, Aug. 1995.

Davis, Mark, "The AC-3 Multichannel Coder", Audio Engineering Society Preprint 3774, 95$^{th}$ AES Convention, Oct. 1993.

Bosi, et al. "High Qualiy, Low-Rate Audio Transform Coding for Transmission and Multimedia Applications," Audio Engineering Society Preprint 3365, 93$^{rd}$ AES Convention, Oct. 1992.

ISO/IEC JTC1/SC29, "Information Technology—Coding of audio-visual objects," ISO/IEC IS-14496 (Part 3) 2001.

ISO/IEC 13818-7. "MPEG-2 advanced audio coding, AAC." International Standard 1997.

Bosi, M., et al., "ISO/IEC MPEG-2 Advanced Audio Coding", Proc. Of the 101$^{st}$ AES-Convention, 1996.

Bosi, M., et al., "ISO/IEC MPEG-2 Advanced Audio Coding", Journal of the AES, vol. 45, No. 10, Oct. 1997, pp. 789-814.

Brandenburg, Karlheinz, "MP3 and AAC Explained," Proc. Of the AES 17$^{th}$ International Conference on High Quality Audio Coding, Florence, Italy, 1999.

Soulodre, G.A., et al., "Subjective Evaluation of State-of-the-Art Two-Channel Audio Codes" J. Audio Eng. Soc., vol. 46, No. 3, pp. 164-177, Mar. 1998.

Faller, et al., "Binaural Cue coding Applied to Stereo and Multi-Channel Audio Compression," Audio Engineering Society Convention Paper 5574, 112$^{th}$ Convention, Munich, May 2002.

Baumgarte, et al., "Why Binaural Cue Coding is Better Than Intensity Stereo Coding," Audio Engineering Society Convention Paper 5575, 112$^{th}$ Convention, Munich, May 2002.

Baumgarte, et al., "Design and Evaluation of Binaural Cue Coding Schemes," Audio Engineering Society Convention Paper 5706, 113$^{th}$ Covention, Los Angeles, Oct. 2002.

Faller, et al., "Efficient Representation of Spatial Audio Using Perceptual Parametrization," IEEE Workshop on Applications of Signal Processing to Audio and Acoustics 2001, New Paltz, New York, Oct. 2001, pp. 199-202.

Baumgarte, et al., "Estimation of Auditory Spatial cues for Binaural Cue Coding", Proc. ICASSP 2002, Orlando, Florida, May 2002, pp. II-1801-1804.

Faller, et al., "Binaural Cue Coding: A Novel and Efficient Representation of Spatial Audio," Proc. ICASSP 2002, Orlando, Florida, May 2002, pp. II-1841-II-1844.

Breebaart, et al., "High-Quality parametric Spatial Audio Coding at Low Bitrates", Audio Engineering Society Convention Paper 6072, 116$^{th}$ Convention, Berlin, May 2004.

Baumgarte, et al., "Audio Coder Enhancement Using Scalable Binaural Cue Coding with Equalized Mixing," Audio Engineering Society Convention Paper 6060, 116$^{th}$ Convention, Berlin, May 2004.

Schuijers, et al., "Low Complexity Parametric Stereo Coding," Audio Engineering Society Convention Paper 6073, 116$^{th}$ Convention, Berlin, May 2004.

Engdegard, et al., "Synthetic Ambience in Parametric Stereo Coding", Audio Engineering Society Convention Paper 6074, 116$^{th}$ Convention, Berlin, May 2004.

Herre, et al., "Intensity Stereo Coding," Audio Engineering Society Preprint 3799, 96$^{th}$ Convention, Amsterdam, 1994.

Xu, Li, Relative importance of temporal envelope and fine structure in lexical-tone perception (L), J. Acoust. Soc. Am., 114 (6), Pt. 1, Dec. 2003.

* cited by examiner

TEMPORAL ENVELOPE SHAPING FOR SPATIAL AUDIO CODING USING FREQUENCY DOMAIN WIENER FILTERING

FIELD OF THE INVENTION

The present invention relates to block-based audio coders in which the audio information, when decoded, has a temporal envelope resolution limited by the block rate, including perceptual and parametric audio encoders, decoders, and systems, to corresponding methods, to computer programs for implementing such methods, and to a bitstream produced by such encoders.

BACKGROUND OF THE INVENTION

Many reduced-bit-rate audio coding techniques are "block-based" in that the encoding includes processing that divides each of the one or more audio signals being encoded into time blocks and updates at least some of the side information associated with the encoded audio no more frequently than the block rate. As a result, the audio information, when decoded, has a temporal envelope resolution limited by the block rate. Consequently, the detailed structure of the decoded audio signals over time is not preserved for time periods smaller than the granularity of the coding technique (typically in the range of 8 to 50 milliseconds per block).

Such block-based audio coding techniques include not only well-established perceptual coding techniques known as AC-3, AAC, and various forms of MPEG in which discrete channels generally are preserved through the encoding/decoding process, but also recently-introduced limited bit rate coding techniques, sometimes referred to as "Binaural Cue Coding" and "Parametric Stereo Coding," in which multiple input channels are downmixed to and upmixed from a single channel through the encoding/decoding process. Details of such coding systems are contained in various documents, including those cited below under the heading "Incorporation by Reference." As a consequence of the use of a single channel in such coding systems, the reconstructed output signals are, necessarily, amplitude scaled versions of each other—for a particular block, the various output signals necessarily have substantially the same fine envelope structure.

Although all block-based audio coding techniques may benefit from an improved temporal envelope resolution of their decoded audio signals, the need for such improvement is particularly great in block-based coding techniques that do not preserve discrete channels throughout the encoding/decoding process. Certain types of input signals, such as applause, for example, are particularly problematic for such systems, causing the reproduced perceived spatial image to narrow or collapse.

SUMMARY OF THE INVENTION

Figure 1:
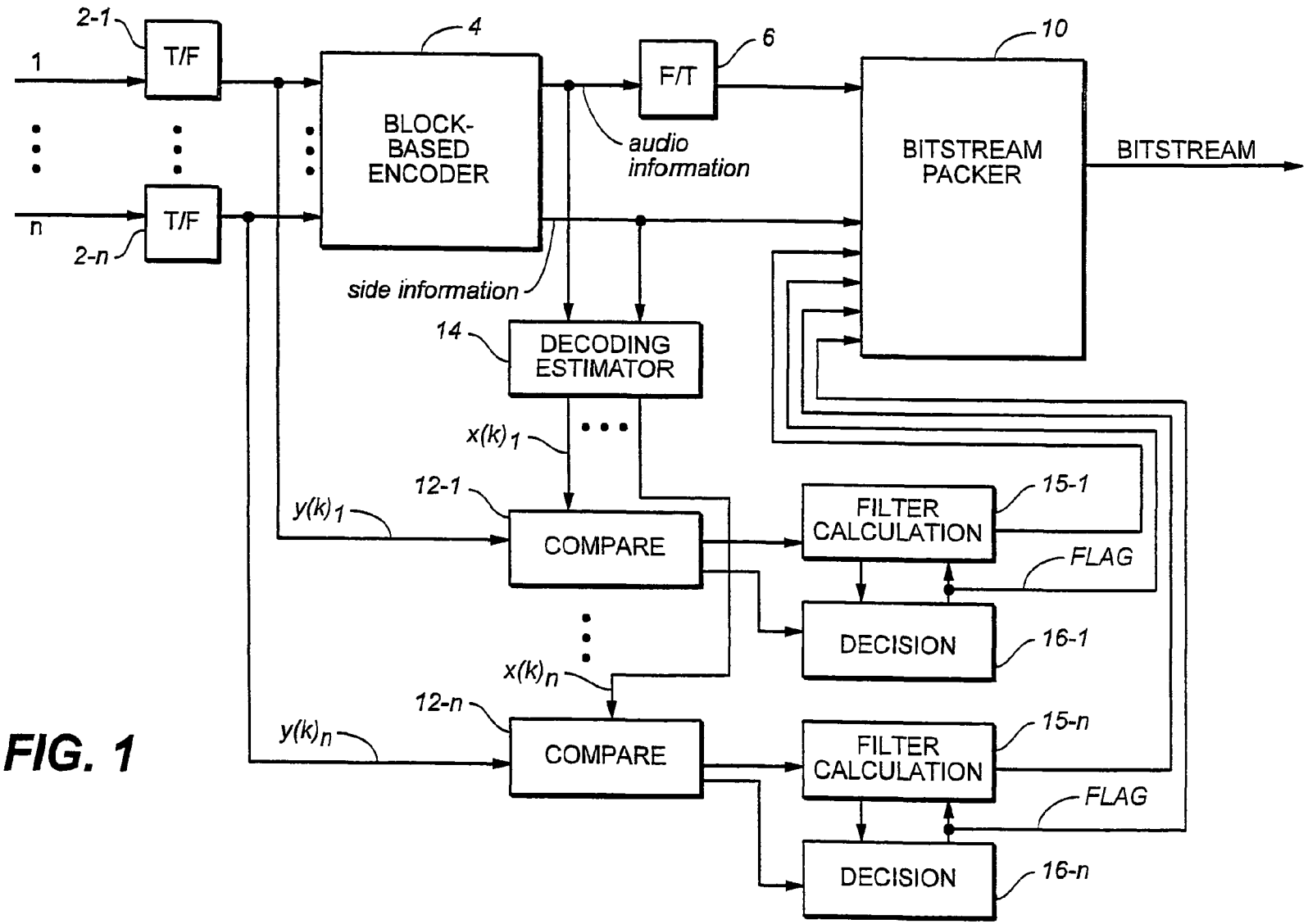
FIG. 1 is a schematic functional block diagram of an encoder or encoding function embodying aspects of the present invention.

In accordance with a first aspect of the invention, a method for audio signal encoding is provided in which one or more audio signals are encoded into a bitstream comprising audio information and side information relating to the audio information and useful in decoding the bitstream, the encoding including processing that divides each of the one or more audio signals into time blocks and updates at least some of the side information no more frequently than the block rate, such that the audio information, when decoded, has a temporal envelope resolution limited by the block rate. Comparing is performed between the temporal envelope of at least one audio signal and the temporal envelope of an estimated decoded reconstruction of each such at least one audio signal, which estimated reconstruction employs at least some of the audio information and at least some of the side information, representations of the results of comparing being useful for improving the temporal envelope resolution of at least some of the audio information when decoded.

In accordance with another aspect of the invention, a method for audio signal encoding and decoding is provided in which one or more input audio signals are encoded into a bitstream comprising audio information and side information relating to the audio information and useful in decoding the bitstream, the bitstream is received and the audio information is decoded using the side information to provide one or more output audio signals, the encoding and decoding including processing that divides each of the one or more input audio signals and the decoded bitstream, respectively, into time blocks, the encoding updating at least some of the side information no more frequently than the block rate, such that the audio information, when decoded, has a temporal envelope having a resolution limited by the block rate. Comparing is performed between the temporal envelope of at least one input audio signal and the temporal envelope of an estimated decoded reconstruction of each such at least one input audio signal, which estimated reconstruction employs at least some of the audio information and at least some of the side information, the comparing providing a representation of the results of comparing, such representations being useful for improving the temporal envelope resolution of at least some of the audio information when decoded. Outputting at least some of the representations is performed, and decoding the bitstream is performed, the decoding employing the audio information, the side information and the outputted representations.

In accordance with a further aspect of the invention, a method for audio signal decoding is provided in which one or more input audio signals have been encoded into a bitstream comprising audio information and side information relating to the audio information and useful in decoding the bitstream, the encoding including processing that divides each of the one or more input audio signals into time blocks and updates at least some of the side information no more frequently than the block rate, such that the audio information, when decoded using the side information, has a temporal envelope resolution limited by the block rate, the encoding further including comparing the temporal envelope of at least one input audio signal and the temporal envelope of an estimated decoded reconstruction of each such at least one input audio signal, which estimated reconstruction employs at least some of the audio information and at least some of the side information, the comparing providing a representation of the results of comparing, such representations being useful for improving the temporal envelope resolution of at least some of the audio information when decoded, and the encoding further including outputting at least some of the representations. Receiving and decoding the bitstream is performed, the decoding employing the audio information, the side information and the outputted representations.

Other aspects of the invention include apparatus adapted to perform the above-stated methods, a computer program, stored on a computer-readable medium for causing a computer to perform the above-stated methods, a bitstream produced by the above-stated methods, and a bitstream produced by apparatus adapted to perform the above-stated methods.

DETAILED DESCRIPTION OF THE INVENTION

FIG. 1 shows an example of an encoder or encoding process environment in which aspects of the present invention may be employed. A plurality of audio input signals such as PCM signals, time samples of respective analog audio signals, 1 through n, are applied to respective time-domain to frequency-domain converters or conversion functions ("T/F") 2-1 through 2-n. The audio signals may represent, for example, spatial directions such as left, center, right, etc. Each T/F may be implemented, for example, by dividing the input audio samples into blocks, windowing the blocks, overlapping the blocks, transforming each of the windowed and overlapped blocks to the frequency domain by computing a discrete frequency transform (DAFT) and partitioning the resulting frequency spectrums into bands simulating the ear's critical bands, for example, twenty-one bands using, for example, the equivalent-rectangular band (ERB) scale. Such DAFT processes are well known in the art. Other time-domain to frequency domain conversion parameters and techniques may be employed. Neither the particular parameters nor the particular technique are critical to the invention. However, for the purposes of ease in explanation, the following description assumes that such a DAFT conversion technique is employed.

The frequency-domain outputs of T/F 2-1 through 2-n are each a set of spectral coefficients. These sets may be designated $Y[k]_1$ through $Y[k]_n$, respectively. All of these sets may be applied to a block-based encoder or encoder function ("block-based encoder") 4. The block-based encoder may be, for example, any one of the known block-based encoders mentioned above alone or sometimes in combination or any future block-based encoders including variations of those encoders mentioned above. Although aspects of the invention are particularly beneficial for use in connection with block-based encoders that do not preserve discrete channels during encoding and decoding, aspects of the invention are useful in connection with virtually any block-based encoder.

The outputs of a typical block-based encoder 4 may be characterized as "audio information" and "side information." The audio information may comprise data representing multiple signal channels as is possible in block-based coding systems such as AC-3, AAC and others, for example, or, it may comprise only a single channel derived by downmixing multiple input channels, such as the afore-mentioned binary cue coding and parametric stereo coding systems (the downmixed channel in a binary cue coding encoder or a parametric stereo coding system may also be perceptually encoded, for example, with AAC or some other suitable coding). It may also comprise a single channel or multiple channels derived by downmixing multiple input channels such as disclosed in U.S. Provisional Patent Application Ser. No. 60/588,256, filed Jul. 14, 2004 of Davis et al, entitled "Low Bit Rate Audio Encoding and Decoding in Which Multiple Channels are Represented By Monophonic Channel and Auxiliary Information." Said Ser. No. 60,588,256 application is hereby incorporated by reference in its entirety. The side information may comprise data that relates to the audio information and is useful in decoding it. In the case of the various downmixing coding systems, the side information may comprise, spatial parameters such as, for example, interchannel amplitude differences, interchannel time or phase differences, and interchannel cross-correlation.

The audio information and side information from the block-based encoder 4 may then be applied to respective frequency-domain to time-domain converters or conversion functions ("F/T") 6 and 8 that each perform generally the inverse functions of an above-described T/F, namely an inverse FFT, followed by windowing and overlap-add. The time-domain information from F/T 6 and 8 is applied to a bitstream packer or packing function ("bitstream packer") 10 that provides an encoded bitstream output. Alternatively, if the encoder is to provide a bitstream representing frequency-domain information, F/T 6 and 8 may be omitted.

The frequency-domain audio information and side information from block-based encoder 4 are also applied to a decoding estimator or estimating function ("decoding estimator") 14. Decoding estimator 14 may simulate at least a portion of a decoder or decoding function designed to decode the encoded bitstream provided by bitstream packer 10. An example of such a decoder or decoding function is described below in connection with FIG. 2. The decoding estimator 14 may provide sets of spectral coefficients $X[k]_1$ through $X[k]_n$ that approximate the sets of spectral coefficients $Y[k]_1$ through $Y[k]_n$ of corresponding input audio signals that are expected to be obtained in the decoder or decoding function. Alternatively, it may provide such spectral coefficients for fewer than all input audio signals, for fewer than all time blocks of the input audio signals, and/or for less than all frequency bands (i.e., it may not provide all spectral coefficients). This may arise, for example, if it is desired to improve only input signals representing channels deemed more important than others. As another example, this may arise if it is desired to improve only the lower frequency portions of signals in which the ear is more sensitive to the fine details of temporal waveform envelopes.

Each of the frequency-domain outputs of T/F 2-1 through 2-n, the sets of spectral coefficients $Y[k]_1$ through $Y[k]n$, are each also applied to respective compare devices or functions ("compare") 12-1 through 12-n. Such sets are compared to corresponding sets of corresponding time blocks of the estimated spectral coefficients $X[k]_1$ through $X[k]_n$ in respective compare 12-1 through 12-n. The results of comparing in each compare 12-1 through 12-n are each applied to a filter calculator or calculation function ("filter calculation") 15-1 through 15-n. This information should be sufficient for each filter calculation to define the coefficients of a filter for each time block, which filter, when applied to a decoded reconstruction of an input signal, would result in the signal having a temporal envelope with an improved resolution. In other words, the filter would reshape the signal so that it more closely replicates the temporal envelope of the original signal. The improved resolution is a resolution finer than the block rate. Further details of a preferred filter are set forth below.

Although the example of FIG. 1 shows the compare and the filter calculation in the frequency domain, in principle, the compare and the filter calculation may be performed in the time domain. Whether performed in the frequency domain or time domain, only one filter configuration is determined per time block (although the same filter configuration may be applied to some number of consecutive time blocks). Although, in principle, a filter configuration may be determined on a band by band basis (such as per band of the ERB scale), doing so would require the sending of a large number of side information bits, which would defeat an advantage of the invention, namely, to improve temporal envelope resolution with a low increase in bit rate.

A measure of the comparing in each compare 12-1 through 12-n is each applied to a decision device or function ("decision") 16-1 through 16-n. Each decision compares the measure of comparing against a threshold. A measure of the comparing may take various forms and is not critical. For example, the absolute value of the difference of each corresponding coefficient value may be calculated and the differences summed to provide a single number whose value indicates the degree to which the signal waveforms differ from one another during a time block. That number may be compared to a threshold such that if it exceeds the threshold a "yes" indicator is provided to the corresponding filter calculation. In the absence of a "yes" indicator, the filter calculations may be inhibited for the block, or, if calculated, they may not be outputted by the filter calculation. Such yes/no information for each signal constitutes a flag that may also be applied to the bitstream packer 10 for inclusion in the bitstream (thus, there may be a plurality of flags, one for each input signal and each of such flags may be represented by one bit).

Alternatively, each decision 16-1 through 16-n may receive information from a respective filter calculation 14-1 through 14-n instead of or in addition to information from a respective compare 12-1 through 12-n. The respective decision 16 may employ the calculated filter characteristics (e.g., their average or their peak magnitudes) as the basis for making a decision or to assist in making a decision.

As mentioned above, each filter calculation 14-1 through 14-n provides a representation of the results of comparing, which may constitute the coefficients of a filter, which filter, when applied to a decoded reconstruction of an input signal would result in the signal having a temporal envelope with an improved resolution. If the spectral estimated spectral coefficients $X[k]_1$ through X[k]n are incomplete (in the case of decoding estimator providing spectral coefficients for fewer than all input audio signals, for fewer than all time blocks of the input audio signals, and/or for less than all frequency bands), there may not be outputs of each compare 12-1 through 12-n for all time blocks, frequency bands and input signals. The reader should note that $X[k]_1$ through $X[k]_n$ refer to reconstructed outputs, whereas $Y[k]_1$ through $Y[k]_n$ refer to inputs.

The output of each filter calculation 14-1 through 14-n may be applied to the bitstream assembler 10. Although the filter information may be sent separately from the bitstream, preferably it is sent as part of the bitstream and as part of the side information. When aspects of the invention are applied to existing block-based encoding systems, the additional information provided by aspects of the present invention may be inserted in portions of the bitstreams of such systems that are intended to carry auxiliary information.

In practical embodiments, not only the audio information, but also the side information and the filter coefficients will likely be quantized or coded in some way to minimize their transmission cost. However, no quantizing and de-quantizing is shown in the figures for the purposes of simplicity in presentation and because such details are well known and do not aid in an understanding of the invention.

Wiener Filter Design in the Frequency Domain

Each of the filter calculation devices or functions 14-1 through 14-n preferably characterizes an FIR filter in the frequency domain that represents the multiplicative changes in the time domain required to obtain a more accurate reproduction of a signal channel's original temporal envelope. This filter problem can be formulated as a least squares problem, which is often referred to as Wiener filter design. See, for example, X. Rong Li, *Probability, Random Signals, and Statistics*, CRC Press 1999, New York, pp. 423. Applying Wiener filter techniques has the advantage of reducing the additional bits required to convey the re-shaping filter information to a decoder. Conventional applications of the Wiener filter typically are designed and applied in the time domain.

The frequency-domain least-squares filter design problem may be defined as follows: given the DAFT spectral representation of an original signal Y[k] and the DAFT spectral representation of an approximation of such original channel X[k], calculate a set of filter coefficients ($a_m$) that minimize equation 1. Note that Y[k] and X[k] are complex values and thus, in general, $a_m$ will also be complex.

$$\min_{a_m}\left[E\left|Y[k]-\sum_{m=0}^{M-1}a_m X[k-m]\right|^2\right], \tag{1}$$

where k is the spectral index, E is the expectation operator, and M is the length of the filter being designed.

Equation 1 can be re-expressed using matrix expressions as shown in equation 2:

$$\min_{a_m}\left[E\left|\overline{Y}_k-\overline{A}^T\overline{X}_k\right|^2\right], \tag{2}$$

where $$\overline{Y}_k=[Y[k]]$$

$$\overline{X}_k^T=[\,X[k]\quad X[k-1]\quad\ldots\quad X[k-M+1]\,]$$

and $$\overline{A}^T=[\,a_0\quad a_1\quad\ldots\quad a_{M-1}\,].$$

Thus, by setting the partial derivatives in equation 2 with respect to each of the filter coefficients to zero, it is simple to show the solution to the minimization problem, which is given by equation 3.

$$\overline{A}=\overline{R}_{XX}^{-1}\overline{R}_{XY}, \tag{3}$$

where $$\overline{R}_{XX}=\begin{bmatrix} E(X_K X_k^*) & E(X_K X_{k-1}^*) & \ldots & E(X_K X_{k-M+1}^*) \\ E(X_{K-1} X_k^*) & E(X_{K-1} X_{k-1}^*) & \ldots & E(X_{K-1} X_{k-M+2}^*) \\ \vdots & \vdots & \iddots & \vdots \\ E(X_{K-M+1} X_k^*) & E(X_{K-M+1} X_{k-1}^*) & \ldots & E(X_{K-M+1} X_{k-M+1}^*) \end{bmatrix}$$

and $$\overline{R}_{YX}^T=[\,E(Y_K X_k^*)\quad E(Y_K X_{k-1}^*)\quad\ldots\quad E(Y_K X_{k-M+1}^*)\,].$$

Equation 3 defines the calculation of the optimal filter coefficients that minimize the error between the original spectrum (Y[k]) and the reconstructed spectrum (X[k]) of a particular channel. Generally, a set of filter coefficients is calculated for every time block of every input signal.

In a practical embodiment of aspects of the invention, a $12^{th}$ order Wiener filter is employed, although the invention is not limited to the use of a Wiener filter of such size. Such practical embodiment employs processing in the frequency domain following a DFT. Consequently, the Wiener filter coefficients are complex numbers and each filter requires the transmission of twenty-four real numbers. To efficiently convey such filter information to a decoder, vector quantization (VQ) may be used to encode the coefficients of each filter. A codebook may be employed such that only an index need be sent to the decoder to convey the $12^{th}$ order complex filter information. In a practical embodiment a VQ table codebook having 24 dimensions and 16,536 entries has been found to be useful. The invention is not limited to the use of vector quantization nor the use of a codebook.

While the description above assumes the use of a DAFT to estimate the spectral content and to design the Wiener filter, in general any transform may be used.

Figure 2:
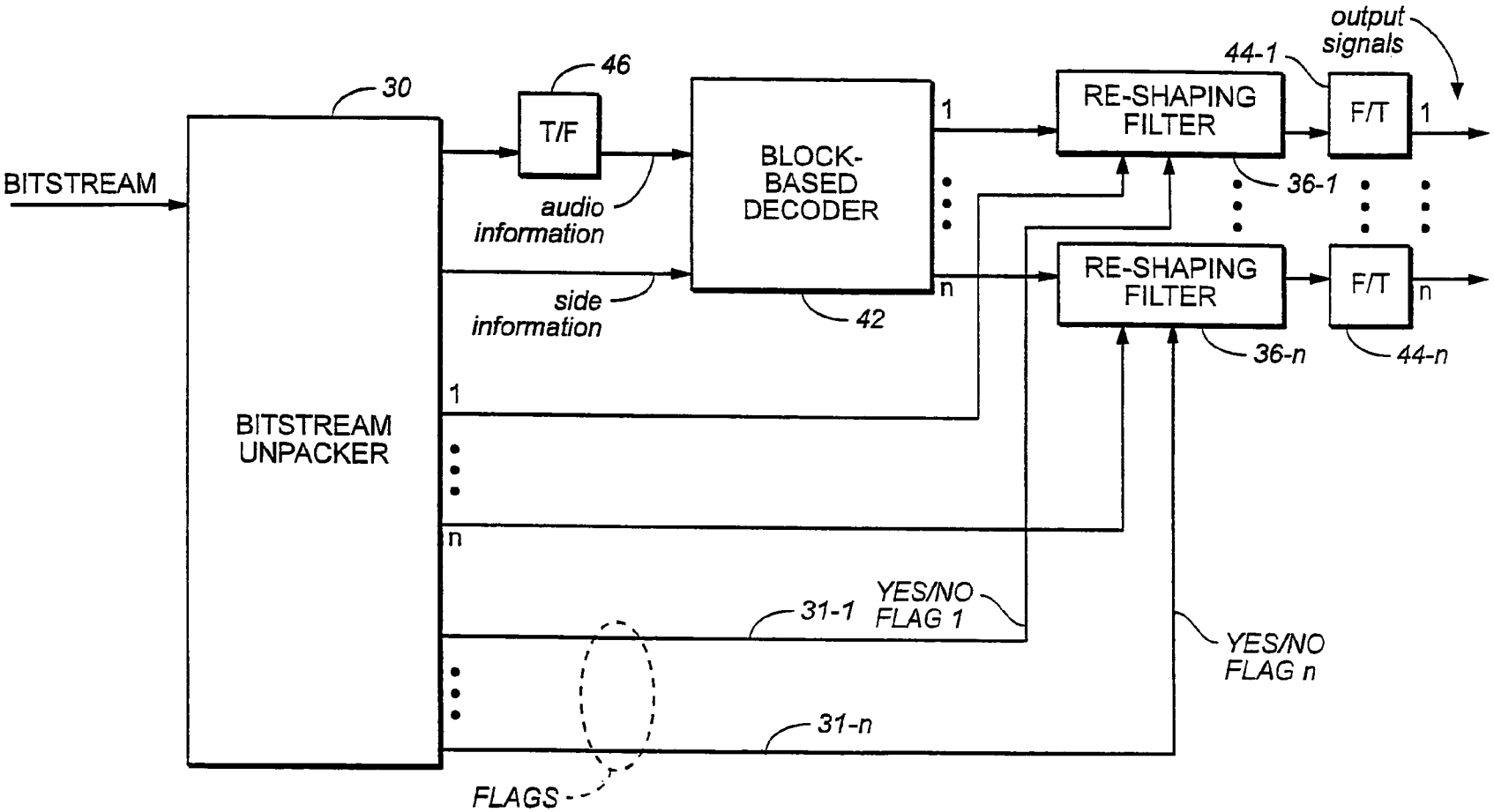
FIG. 2 is a schematic functional block diagram of a decoder or decoding function embodying aspects of the present invention.

FIG. 2 shows an example of a decoder or decoding process environment in which aspects of the present invention may be employed. Such an encoder or encoding process may be suitable for operation in cooperation with an encoder or encoding process as described in connection with the example of FIG. 1. An encoded bitstream, such as that produced by the arrangement of FIG. 1, is received by any suitable mode of signal transmission or storage and applied to a bitstream unpacker 30 that unpacks the bitstream as necessary to separate the encoded audio information from the side information and yes/no flags (if included in the bitstream). The side information preferably includes a set of filter coefficients for use in improving the reconstruction of each of the one or more of the input signals that were applied to the encoding arrangement of FIG. 1.

In this example, it is assumed that there is a reproduced signal corresponding to each input signal and that temporal envelope re-shaping filter information is provided for every reproduced signal, although this need not be the case, as is mentioned above. Thus, 1 through n sets of filter coefficient side information are shown as output from the bitstream unpacker 30. The filter coefficient information for each input signal is applied to respective re-shaping filters 36-1 through 36-n, whose operation is explained below. Each of the filters may also receive a respective yes/no flag 31-1 through 31-n, indicating whether the filter should be active during a particular time block.

The side information from bitstream packer 30 may also include other information such as, for example, interchannel amplitude differences, interchannel time or phase differences, and interchannel cross-correlation in the case of a binaural cue coding or parametric stereo system. A block-based decoder 42 receives the side information from bitstream unpacker 30 along with the time- to frequency-domain converted audio information from the bitstream unpacker 30. The audio information from the unpacker 30 is applied via a time-domain to frequency-domain converter or conversion function ("T/F") 46, which may be the same as any one of the frequency-domain converters or conversion functions ("T/F") 2-1 through 2-n of FIG. 1.

The block-based decoder 42 provides one or more outputs, each of which is an approximation of a corresponding input signal in FIG. 1. Although some input signals may not have a corresponding output signal, the example of FIG. 2 shows output signals 1 through n, each of which is an approximation corresponding to a respective one of the input signals 1 through n of FIG. 1. In this example, each of the output signals 1 through n of the decoder 42 are applied to a respective re-shaping filter 36-1 through 36-n, each of which may be implemented as an FIR filter. The coefficients of each FIR filter are controlled, on a block basis, by the respective filter information relating to a particular input channel whose reconstructed output is to be improved. Multiplicative envelope reshaping in the time domain preferably is achieved by convolving each FIR filter with a block-based decoder output in each of filters 36-1 through 36-n. Thus, temporal envelope shaping in accordance with the aspects of the present invention takes advantage of the time frequency duality—convolution in the time domain is equivalent to multiplication in the frequency domain and vice versa. Each of the decoded and filtered output signals is then applied to respective frequency-domain to time-domain converters or conversion functions ("F/T") 44-1 through 44-n that each perform the inverse functions of an above-described T/F, namely an inverse FFT, followed by windowing and overlap-add. Alternatively, a suitable time-domain re-shaping filter may be employed following each of the frequency- to time-domain converters. For example, the n polynomial coefficients of an nth order polynomial curve may be sent as side information instead of FIR filter coefficients and the curve applied by multiplication in the time domain. Although it is preferred to employ Wiener filter techniques to convey the re-shaping filter information to the decoder, other frequency-domain and time-domain techniques may be employed such as those set forth in U.S. patent application Ser. No. 10/113,858 of Truman and Vinton, entitled "Broadband Frequency Translation for High Frequency Regeneration," filed Mar. 28, 2002 and published as US 2003/0187663 A1 on Oct. 2, 2003. Said application is hereby incorporated by reference in its entirety.

Implementation

The invention may be implemented in hardware or software, or a combination of both (e.g., programmable logic arrays). Unless otherwise specified, the algorithms included as part of the invention are not inherently related to any particular computer or other apparatus. In particular, various general-purpose machines may be used with programs written in accordance with the teachings herein, or it may be more convenient to construct more specialized apparatus (e.g., integrated circuits) to perform the required method steps. Thus, the invention may be implemented in one or more computer programs executing on one or more programmable computer systems each comprising at least one processor, at least one data storage system (including volatile and non-volatile memory and/or storage elements), at least one input device or port, and at least one output device or port. Program code is applied to input data to perform the functions described herein and generate output information. The output information is applied to one or more output devices, in known fashion.

Each such program may be implemented in any desired computer language (including machine, assembly, or high level procedural, logical, or object oriented programming languages) to communicate with a computer system. In any case, the language may be a compiled or interpreted language.

Each such computer program is preferably stored on or downloaded to a storage media or device (e.g., solid state memory or media, or magnetic or optical media) readable by a general or special purpose programmable computer, for configuring and operating the computer when the storage media or device is read by the computer system to perform the procedures described herein. The inventive system may also be considered to be implemented as a computer-readable storage medium, configured with a computer program, where the storage medium so configured causes a computer system to operate in a specific and predefined manner to perform the functions described herein. A number of embodiments of the invention have been described. Nevertheless, it will be understood that various modifications may be made without departing from the spirit and scope of the invention. For example, some of the steps described herein may be order independent, and thus can be performed in an order different from that described.

Incorporation by Reference

The following patents, patent applications and publications are hereby incorporated by reference, each in their entirety.

AC-3

ATSC Standard A52/A: Digital Audio Compression Standard (AC-3), Revision A, Advanced Television Systems Committee, 20 Aug. 2001. The A/52A document is available on the World Wide Web at http://www.atsc.org/standards.html. "Design and Implementation of AC-3 Coders," by Steve Vernon, *IEEE Trans. Consumer Electronics*, Vol. 41, No. 3, August 1995.

"The AC-3 Multichannel Coder" by Mark Davis, Audio Engineering Society Preprint 3774, 95th AES Convention, October, 1993.

"High Quality, Low-Rate Audio Transform Coding for Transmission and Multimedia Applications," by Bosi et al, Audio Engineering Society Preprint 3365, 93rd AES Convention, October, 1992.

U.S. Pat. Nos. 5,583,962; 5,632,005; 5,633,981; 5,727,119; and 6,021,386.

AAC

ISO/IEC JTC1/SC29, "Information technology—very low bitrate audio-visual coding," ISO/IEC IS-14496 (Part 3, Audio), 1996

1) ISO/IEC 13818-7. "MPEG-2 advanced audio coding, AAC". International Standard, 1997;

M. Bosi, K. Brandenburg, S. Quackenbush, L. Fielder, K. Akagiri, H. Fuchs, M. Dietz, J. Herre, G. Davidson, and Y. Oikawa: "ISO/IEC MPEG-2 Advanced Audio Coding". *Proc. of the* 101*st AES-Convention,* 1996;

M. Bosi, K. Brandenburg, S. Quackenbush, L. Fielder, K. Akagiri, H. Fuchs, M. Dietz, J. Herre, G. Davidson, Y. Oikawa: "ISO/IEC MPEG-2 Advanced Audio Coding", *Journal of the AES*, Vol. 45, No. 10, October 1997, pp. 789-814;

Karlheinz Brandenburg: "MP3 and AAC explained". *Proc. of the AES* 17*th International Conference on High Quality Audio Coding*, Florence, Italy, 1999; and G. A. Soulodre et al.: "Subjective Evaluation of State-of-the-Art Two-Channel Audio Codecs" *J. Audio Eng. Soc.*, Vol. 46, No. 3, pp 164-177, March 1998.

MPEG Intensity Stereo

U.S. Pat. Nos. 5,323,396; 5,539,829; 5,606,618 and 5,621,855.

United States Published Patent Application US 2001/0044713, published.

Spatial and Parametric Coding

U.S. Provisional Patent Application Ser. No. 60/588,256, filed Jul. 14, 2004 of Davis et al, entitled "Low Bit Rate Audio Encoding and Decoding in Which Multiple Channels are Represented By Monophonic Channel and Auxiliary Information."

United States Published Patent Application US 2003/0026441, published Feb. 6, 2003

United States Published Patent Application US 2003/0035553, published Feb. 20, 2003, United States Published Patent Application US 2003/0219130 (Baumgarte & Faller) published Nov. 27, 2003, Audio Engineering Society Paper 5852, March 2003

Published International Patent Application WO 03/090206, published Oct. 30, 2003

Published International Patent Application WO 03/090207, published Oct. 30, 2003

Published International Patent Application WO 03/090208, published Oct. 30, 2003

Published International Patent Application WO 03/007656, published Jan. 22, 2003

United States Published Patent Application Publication US 2003/0236583 A1, Baumgarte et al, published Dec. 25, 2003, "Hybrid Multi-Channel/Cue Coding/Decoding of Audio Signals," application Ser. No. 10/246,570.

"Binaural Cue Coding Applied to Stereo and Multi-Channel Audio Compression," by Faller et al, Audio Engineering Society Convention Paper 5574, 112$^{th}$ Convention, Munich, May 2002.

"Why Binaural Cue Coding is Better than Intensity Stereo Coding," by Baumgarte et al, Audio Engineering Society Convention Paper 5575, 112$^{th}$ Convention, Munich, May 2002.

"Design and Evaluation of Binaural Cue Coding Schemes," by Baumgarte et al, Audio Engineering Society Convention Paper 5706, 113$^{th}$ Convention, Los Angeles, October 2002.

"Efficient Representation of Spatial Audio Using Perceptual Parametrization," by Faller et al, IEEE Workshop on Applications of Signal Processing to Audio and Acoustics 2001, New Paltz, N.Y., October 2001, pp. 199-202.

"Estimation of Auditory Spatial Cues for Binaural Cue Coding," by Baumgarte et al, Proc. ICASSP 2002, Orlando, Fla., May 2002, pp. II-1801-1804.

"Binaural Cue Coding: A Novel and Efficient Representation of Spatial Audio," by Faller et al, Proc. ICASSP 2002, Orlando, Fla., May 2002, pp. II-1841-II-1844.

"High-quality parametric spatial audio coding at low bitrates," by Breebaart et al, Audio Engineering Society Convention Paper 6072, 116$^{th}$ Convention, Berlin, May 2004.

"Audio Coder Enhancement using Scalable Binaural Cue Coding with Equalized Mixing," by Baumgarte et al, Audio Engineering Society Convention Paper 6060, 116$^{th}$ Convention, Berlin, May 2004.

"Low complexity parametric stereo coding," by Schuijers et al, Audio Engineering Society Convention Paper 6073, 116$^{th}$ Convention, Berlin, May 2004.

"Synthetic Ambience in Parametric Stereo Coding," by Engdegard et al, Audio Engineering Society Convention Paper 6074, 116$^{th}$ Convention, Berlin, May 2004.

Other

U.S. Pat. No. 5,812,971, Herre, "Enhanced Joint Stereo Coding Method Using Temporal Envelope Shaping," Sep. 22, 1998

"Intensity Stereo Coding," by Herre et al, Audio Engineering Society Preprint 3799, 96$^{th}$ Convention, Amsterdam, 1994.

The invention claimed is:

1. A method for audio signal decoding in which one or more input audio signals have been encoded into a bitstream comprising:

receiving a bitstream, the bitstream comprising audio information and side information relating to the audio information and useful in decoding the bitstream, the encoding including processing that divides each of the one or more input audio signals into time blocks and updates at least some of the side information no more frequently than the block rate, such that the audio information, when decoded using the side information, has a resolution limited by the block rate, the encoding further including comparing an envelope of at least one input audio signal and an envelope of a signal based on the at least one input audio signal as encoded, the comparing providing a representation of the results of comparing, such representation being useful for improving the resolution of at least some of the audio information when decoded, and the encoding further including outputting at least some of the representations, and decoding the bitstream, the decoding employing the audio information, the side information, and the outputted representations.

2. The method according to claim 1, wherein the signal based on at least one input audio signal as encoded comprises an estimated decoded reconstruction of the at least one input audio signal, which estimated reconstruction employs at least some of the audio information and at least some of the side information.

3. The method according to claim 1, wherein the compared envelopes comprise temporal envelopes.

4. The method according to claim 1, wherein the input audio signal comprises a frequency domain representation.

5. The method according to claim 1, wherein the input audio signal comprises a time domain representation.

6. An audio signal decoder in which one or more input audio signals have been encoded into a bitstream comprising:

an input receiving the bitstream, the bitstream comprising audio information and side information relating to the audio information and useful in decoding the bitstream, the encoding including processing that divides each of the one or more input audio signals into time blocks and updates at least some of the side information no more frequently than the block rate, such that the audio information, when decoded using the side information, has a resolution limited by the block rate, the encoding further including comparing an envelope of at least one input audio signal and an envelope of a signal based on the at least one input audio signal as encoded, the comparing providing a representation of the results of comparing, such representations being useful for improving the resolution of at least some of the audio information when decoded, and the encoding further including outputting at least some of the representations, and a decoder decoding the bitstream, the decoder employing the audio information, the side information and the outputted representations.

7. The decoder according to claim 6, wherein the signal based on at least one input audio signal as encoded comprises an estimated decoded reconstruction of the at least one input audio signal, which estimated reconstructions employs at least some of the audio information and at least some of the side information.

8. The decoder according to claim 6, wherein the compared envelopes comprise temporal envelopes.

9. The decoder according to claim 6, wherein the input audio signal comprises a frequency domain representation.

10. The decoder according to claim 6, wherein the input audio signal comprises a time domain representation.

11. An audio decoder, comprising:

a bitstream receiving device configured to receive an encoded signal and extract encoded audio and side information from the encoded signal;

a decoder configured to decode the encoded audio;

a re-shaping device configured to re-shape the decoded audio based on at least part of the side information, wherein side information includes an envelope comparison of an envelope of an audio signal and an envelope of the encoded audio signal and is useful for improving the resolution of the decoded audio.

12. The audio decoder according to claim 11 wherein the decoder is configured to update the side information at a block rate of the encoded signal.

13. The audio decoder according to claim 11, wherein the decoder is configured to decode multiple audio channels from the encoded signal and re-shape each decoded audio channel using a reshaping comparison based on the corresponding decoded channel's original audio signal.

* * * * *